United States Patent [19]

Hunter

[11] Patent Number: 4,809,988

[45] Date of Patent: Mar. 7, 1989

[54] GOAL APPARATUS

[76] Inventor: Richard C. Hunter, 298 Inwood Blvd., Avon Lake, Ohio 44012

[21] Appl. No.: 111,920

[22] Filed: Oct. 21, 1987

[51] Int. Cl.[4] ..... A63B 63/04

[52] U.S. Cl. ..... 273/400; 273/177 A; 273/177 B; 273/408; 273/410; 273/411

[58] Field of Search ..... 273/400, 410, 177 B, 273/177 A, 117 R, 181 F, 1.5 R, 378, 411, 408

[56] References Cited

U.S. PATENT DOCUMENTS

| | | | |
|---|---|---|---|
| 1,166,496 | 1/1916 | Torrey | 273/410 X |
| 1,297,055 | 3/1919 | Austin | 273/177 B |
| 1,529,749 | 3/1925 | Morrison, Jr. | 273/177 A |
| 3,100,115 | 8/1963 | Breneman | 273/410 |
| 3,227,449 | 1/1966 | Schwab | 273/181 F X |
| 3,338,579 | 8/1967 | McKain | 273/177 A X |
| 3,512,783 | 5/1970 | Anderson | 273/177 R |
| 3,602,504 | 8/1971 | Chapman | 273/1.5 R |
| 3,784,199 | 1/1974 | Chmela | 273/398 |
| 4,039,189 | 8/1977 | Headrick et al. | 273/400 |
| 4,691,922 | 9/1987 | Peel et al. | 273/177 B |

FOREIGN PATENT DOCUMENTS

| | | | |
|---|---|---|---|
| 1476 | of 1909 | United Kingdom | 273/177 A |
| 400422 | 8/1933 | United Kingdom | 273/177 A |

*Primary Examiner*—Paul E. Shapiro

[57] ABSTRACT

A goal apparatus for a game which selectively traps incoming objects such as softballs, soccer balls, footballs, and other objects, propelled at the goal from any, direction around the perimeter of the goal, by individual suspended members, draped ropes or chains, or netting.

19 Claims, 6 Drawing Sheets

GOAL APPARATUS

FIELD AND BACKGROUND OF THE INVENTION

The present invention relates, in general, to games in which the participants kick or throw balls or objects at goals to score points and, in particular, to a goal apparatus for trapping incoming balls or objects from any direction around the perimeter of the goal.

The game of golf, while an extremely popular game throughout a good part of the world, can require a substantial investment in equipment and time, not only for the individual player but for the proprietor of the course itself. For golf courses situated in those parts of the country that experience relatively good weather year around, efficient utilization of such a facility is generally not a problem. For golf courses situated in the more northern climates, however, year-round use is generally prevented by cold, rain and snow in the winter months.

Other "fair-weather" sports tend to experience a decline in activity when the weather turns sour, most notably games such as softball and/or soccer. For many players of these games, the return of winter also means a decline in that play will eventually cease until spring of the following year. While other forms of recreation and conditioning exist during the winter months, many players would prefer to practice skills at least somewhat similar to those employed during their summertime activities.

It has thus become desirable to develop a new and novel game, and in particular a goal apparatus, that would allow increased usage of golf courses during the winter months while at the same time refining the skills of participants in softball, soccer and similar games.

Such goal design should take into consideration some or all of the following:

1. The goal itself should offer little, if any obstructions to approach shots from any direction;
2. The goal should capture and hold the incoming balls or other objects within its perimeter to indicate successful completion of the hole;
3. The size the goal should be such that a degree of player approach shot caution is required, similar to that required of putts in regular golf;
4. The goal should be made of materials that can withstand the severest weather conditions and at the same time be of light weight to minimize installation and transportation problems;
5. The goal should be highly visible;
6. The goal should be easy to assemble with a minimum of readily available, common tools and be easily dismantled or folded up for removal and storage when desired; and
7. The goal design should offer reasonable resistance to theft and vandalism.

SUMMARY OF THE INVENTION

The present invention provides a new and novel goal apparatus for a game which can be utilized on existing golf courses and the like with a minimum of interference/damage to the course itself.

Accordingly, one aspect of the present invention is to provide a goal apparatus for a game having means for selectively trapping objects propelled at the goal from any direction around the perimeter of the goal.

Another aspect of the present invention is to provide a goal apparatus for a game having frame members which are removably clamped together at a common location substantially at the center of the goal which both support the goal above a playing surface and provide support for means for selectively trapping objects propelled at the goal from any direction around the perimeter of the goal.

Still another aspect of the present invention is to provide a goal apparatus for a game having frame members which are removably clamped together at locations around the perimeter of the goal, which both support the goal above a playing surface and provide support for means for selectively trapping objects propelled at the goal from substantially any direction around the perimeter of the goal, and which further provides means which are placed under the goal to further define when an object has been successfully trapped by the goal.

The various features of novelty which characterize the invention are pointed out with particularity in the claims annexed to and forming a part of this disclosure. For a better understanding of the present invention and the advantages attained by its use, reference is made to the accompanying drawings and descriptive matter in which preferred embodiments of the invention are illustrated.

DESCRIPTION OF THE PREFERRED EMBODIMENTS

Figure 1:
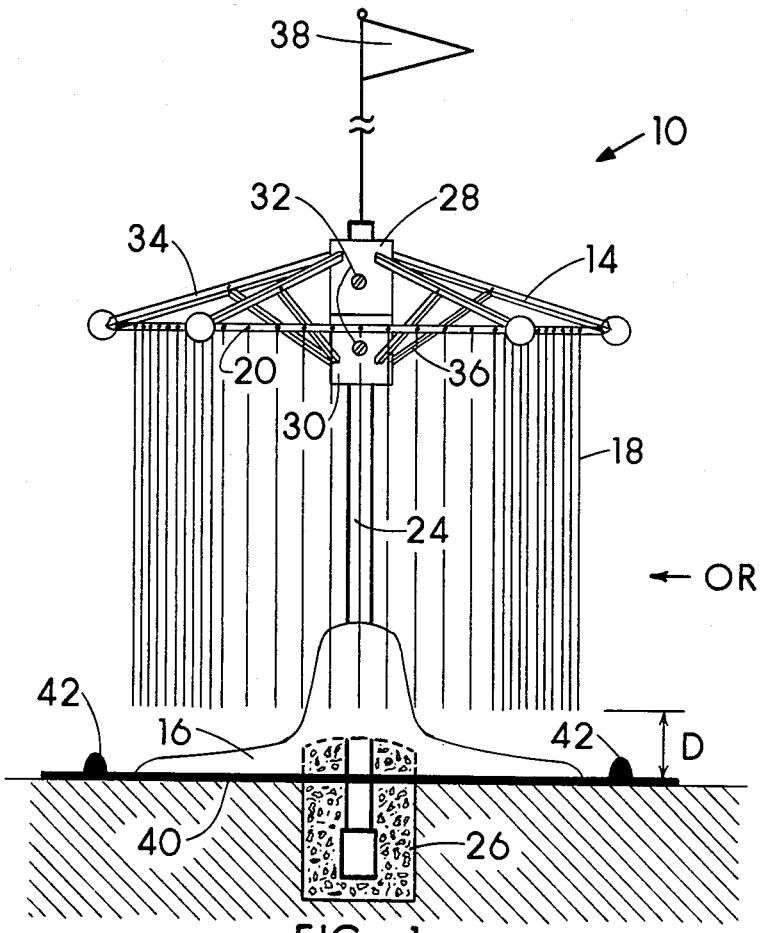
FIG. 1 is a side view of a first embodiment of a goal apparatus according to the present invention.

Referring to the drawings generally, wherein like numerals designate the same element throughout the several drawings, and to FIG. 1 in particular, there is shown a goal 10 which rests upon or partially in a playing surface 12. It is to be noted that while the following detailed description is presented in the context of a goal 10 which can be used in playing an outdoor game, it is understood that the goal 10 could be just as easily adapted for indoor use as well.

In a first embodiment, the goal 10 is generally comprised of a frame 14 which is supported above the playing surface 12 by a base 16 which may rest upon or partially within the playing surface 12. Suspended from the frame 14 are trapping means 18 for selectively trapping objects (not shown) which are propelled at the goal 10 from any direction around the perimeter of the goal 10 by those individuals playing the game. Since the present invention is anticipated to be an "off-season" practice opportunity for those who play soccer, softball, baseball, and the like, the objects typically employed will be the balls used in these sports. However, the present invention could be easily adapted for use in playing games where the objects are not necessarily round, such as footballs, or where the objects are flat or saucer-shaped. One well-known example of the latter is described in U.S. Pat. No. 3,359,678, otherwise known as the FRISBEE. (FRISBEE is a registered trademark of the WHAM-O Manufacturing Company, San Gabriel, Calif., U.S.A.).

The trapping means 18 for selectively trapping objects propelled at the goal 10 from any direction around the perimeter thereof comprise, in a first embodiment, at least one layer of individual, suspended members 18 which are arranged around the perimeter of the goal 10. The members 18 are suspended from rods 19 attached to the frame 14 and are arranged next to one another to form a screen or curtain. The members 18 are pivotally attached to the rods 19 at only one end 20 thereof, may be rigid or flexible in construction, and will usually be suspended at some distance D above the playing surface 12. This distance D will depend upon the type of object used in a game employing the goal 10; factors to consider would include the size of the object, its ability to roll on the playing surface 12, and whether the members 18 are flexible or rigid (rigid members 18 requiring at least some clearance to permit them to swing freely from the frame 14). While the cross-sectional profile of the individual members 18 is not critical, solid or hollow tubular type members 18 can be employed. Sections of rope or links of chain can also be used for the flexible members 18 configuration.

Figure 2:
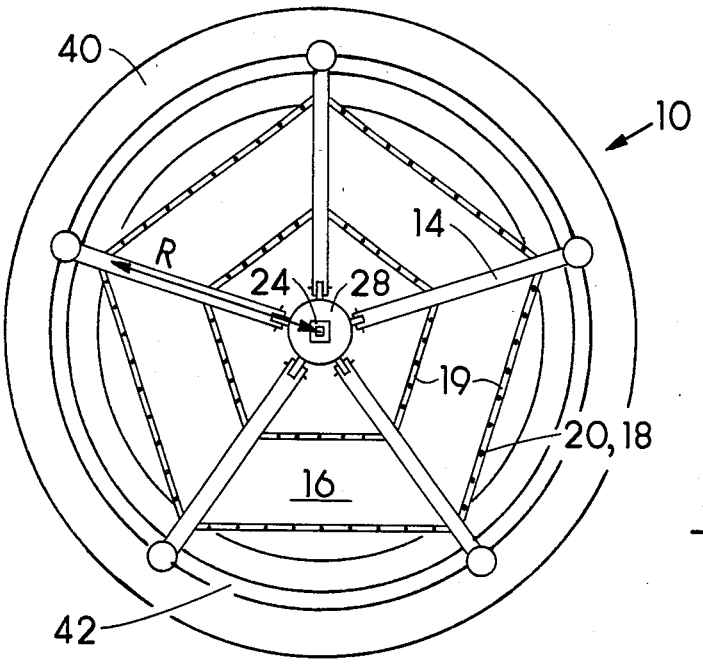
FIG. 2 is a plan view of FIG. 1.

When an incoming object is propelled at the goal 10 with sufficient force, the members 18, being pivotally attached at only one end 20 thereof to the rods 19 attached to the frame 14, can swing freely and deflect out of the way when struck by the incoming object. A properly struck or thrown object which enters the layer of members 18 will pass therethrough, but will thus become trapped inside the goal 10. As shown in FIGS. 1 and 2, the layer of members 18 is capable of selectively trapping incoming objects from any direction around the perimeter of the goal 10.

Selection of the size, spacing and weight of the individual members 18 will depend upon the particular type of object which will be employed in playing a game with the goal 10. As is shown in FIG. 2, one need not employ only a single layer of members 18; multiple layers can be used. The overall design of the goal 10 should require some degree of player caution, just as, in the game of golf, hole size and green conditions play an important role and require approach caution. It may be desirable to choose the design parameters of the members 18 to allow a close, hard-kicked, struck or thrown ball or object to pass through the goal 10 and avoid the use of multiple layers of members 18.

The means for selectively trapping the incoming objects from any direction around the perimeter of the goal 10 can also be comprised of one or more layers of flexible, suspended netting 22. Referring to inset FIG. 1A, the netting 22, like the individual members 18, is suspended from the rods 19 attached to the frame 14, and may but need not end at a distance D above the playing surface 12. The openings of the netting 22 and the weight and stiffness thereof would again be selected based upon the type of objects propelled at the goal 10, and can be selected so that an object could either be trapped in the netting 22, could pass through the netting 22 itself, or, by deflection of the netting 22 capture the object behind the netting 22, thus effecting the selective trapping feature of the present invention.

The frame 14, in a first preferred embodiment, is preferably an adjustable, umbrella type assembly for ease of set-up and transportation. As shown in FIGS. 1 and 2, the frame 14 would typically comprise a vertical central mounting shaft 24 which is attached at a lower end to the base 16. The central mounting shaft 24 can be a square metal pipe which could be removably slipped into the base 16 which rests upon the playing surface 12, or into a submerged or partially recessed insert assembly 26 placed into the playing surface 12. A top coupling 28 and a bottom coupling 30 are slidably positioned and fixed at any position along the height of the central mounting shaft 24 by means of set or thumb screws 32. Rotatably attached to the upper coupling 28 are one end of each of a series of upper frame arms 34; rotatably attached to the lower coupling 30 are one end of each of a series of lower frame arms 36, equal in number to the number of upper frame arms 34.

The lower frame arms 36 are rotatably attached at their distal ends opposite their attachment point to the lower coupling 30 to the upper frame arms 34, such that an umbrella-type frame assembly is created. By proper choice of the location of the upper and lower couplings 28, 30 on the central shaft 24, the suspended members 18 or netting 22 can be positioned at a desired distance R away from the central mounting shaft 24 and at the desired vertical distance D above the playing surface 12.

Preferred dimensions for an installed and expanded goal 10 are a height of 36 inches and a diameter of 30 inches. If necessary, a flag pole 38 could be added to the center of the goal 10, extending out of the central mounting shaft 24, to aid in locating the goal 10 in hilly or rolling terrain. While a five-sided goal 10 has been shown and described in FIGS. 1 and 2, it is recognized that other multi-sided configurations can be employed, as well as a circular (viewed from the top of the goal) design, by proper choice of the number of frame arms 34, 36 and whether the rods 19 are straight, bent, or arcuate in form.

To further assist in defining successful shots at the goal 10, a solid rubber or plastic mat 40 having a raised ridge 42 could be employed as shown in FIG. 1. The mat 40 would extend beyond the trapping means 18 for selectively trapping the objects propelled at the goal 10 by about 6 inches or so to prevent grass or weed growth inside the goal 10, and which would permit close lawn mowing work near the goal 10 without requiring moving the goal 10. The raised ridge 42 would be placed coextensive with the trapping means (members 18 or netting 22) to define a successful shot at the goal.

Figure 4:
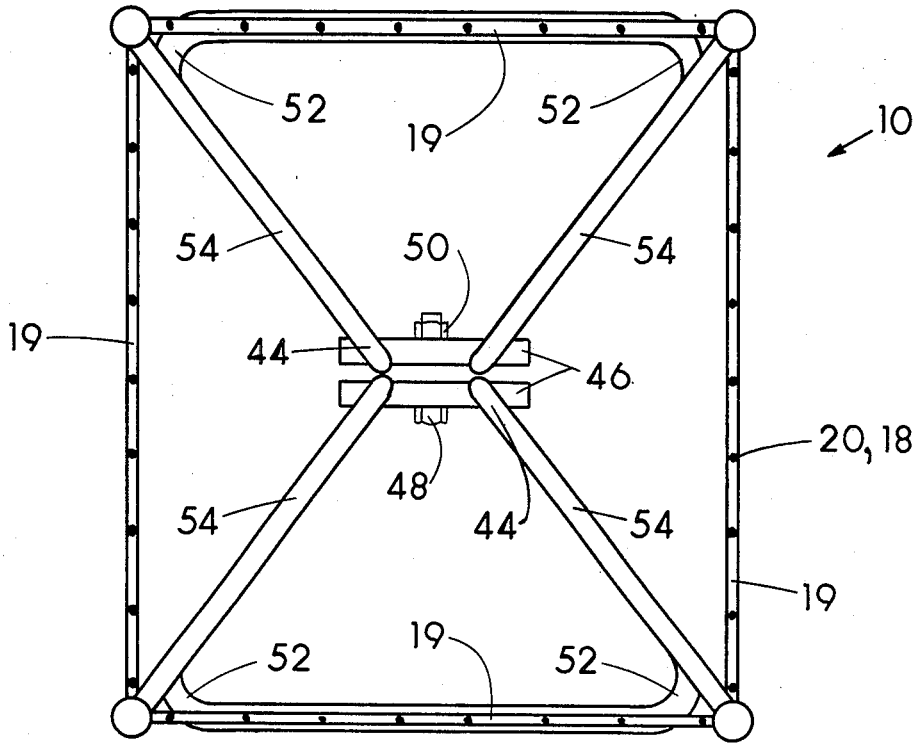
FIG. 4 is a plan view of FIG. 3.
Figure 3:
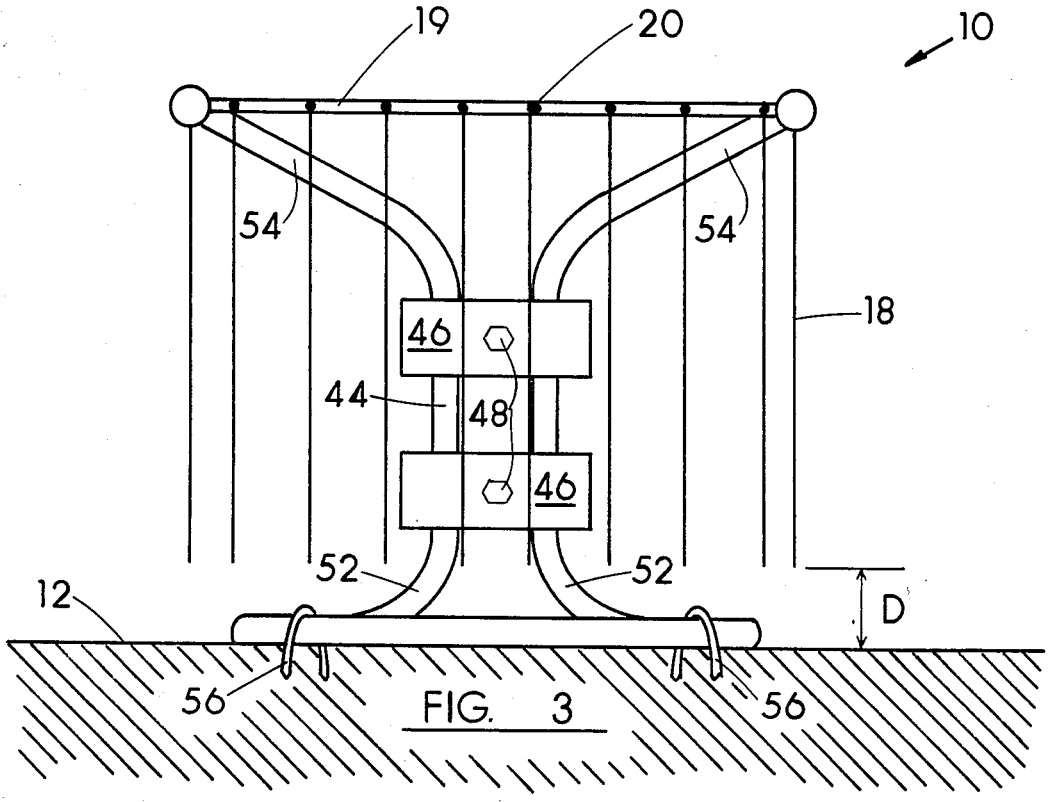
FIG. 3 is a side view of a second embodiment of a goal apparatus according to the present invention.

Referring to FIGS. 3 and 4, there is shown therein a second embodiment of a goal apparatus according to the principles of the present invention. In this embodiment, the goal 10 is comprised of a series of identical bent tubular frame members 44 removably clamped together at substantially the center of the goal 10 by means of clamp pieces 46 held together by bolts 48 and nuts 50. Each bent tubular frame member 44 has outwardly directed lower legs 52 for supporting the goal 10 above the playing surface 12 and outwardly directed upper arms 54 for supporting/suspending the selective trapping means 18 (or netting 22). As shown in FIG. 3, the goal 10 sets upon the playing surface 12 and may require some sort of stapling 56 to prevent movement and tipping of the goal 10.

Figure 6:
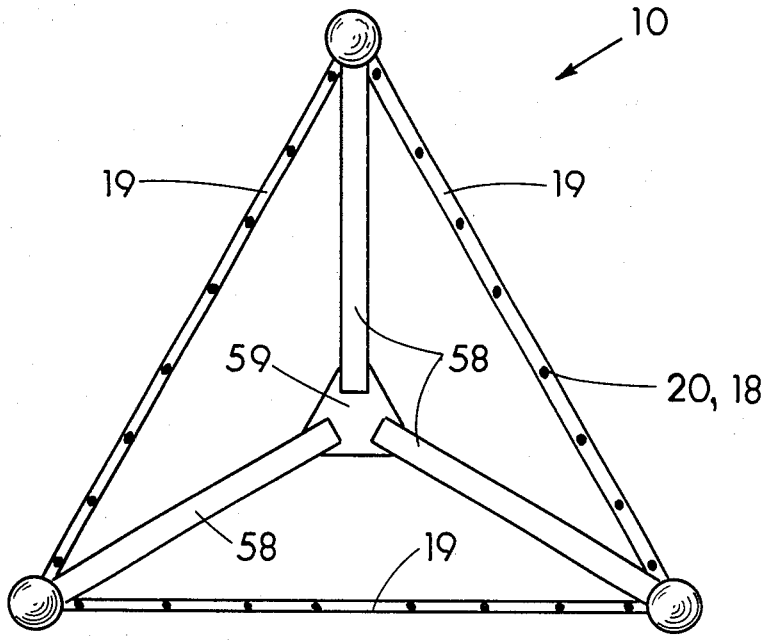
FIG. 6 is a plan view of FIG. 5.
Figure 5:
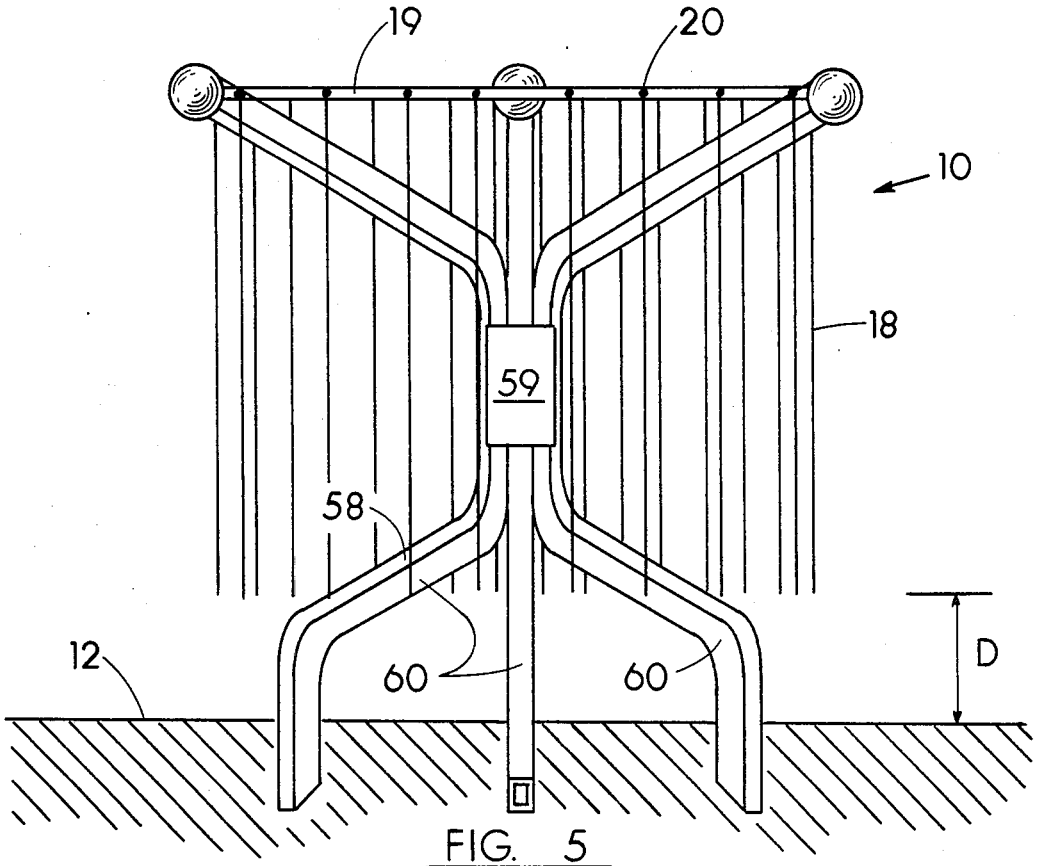
FIG. 5 is a side view of a third embodiment of a goal apparatus according to the present invention.

FIGS. 5 and 6 show an embodiment similar to that of FIG. 3 and 4, in that the frame members 58 are again removably clamped together at substantially the center of the goal 10 by means of a clamp 59. In this embodiment, however, outwardly directed lower legs 60 are driven into the ground or playing surface 12 to support the goal 10. As is shown therein, alternative tubular structures' cross-sections may be employed, such as the square or rectangular cross-section shown. The particular cross-section chosen will depend on a variety of factors, such as strength and rigidity.

Figure 8:
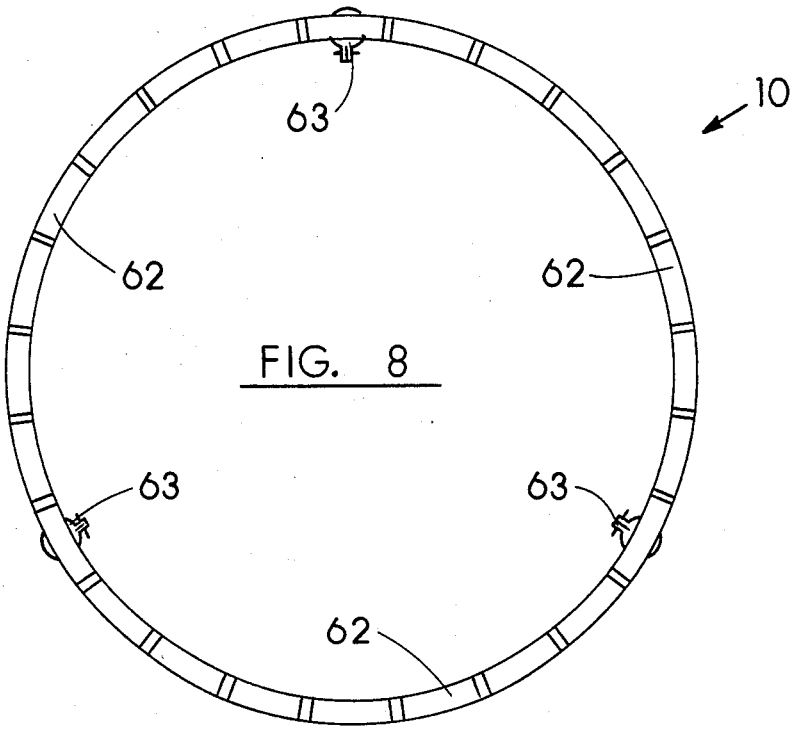
FIG. 8 is a plan view of FIG. 7.
Figure 7:
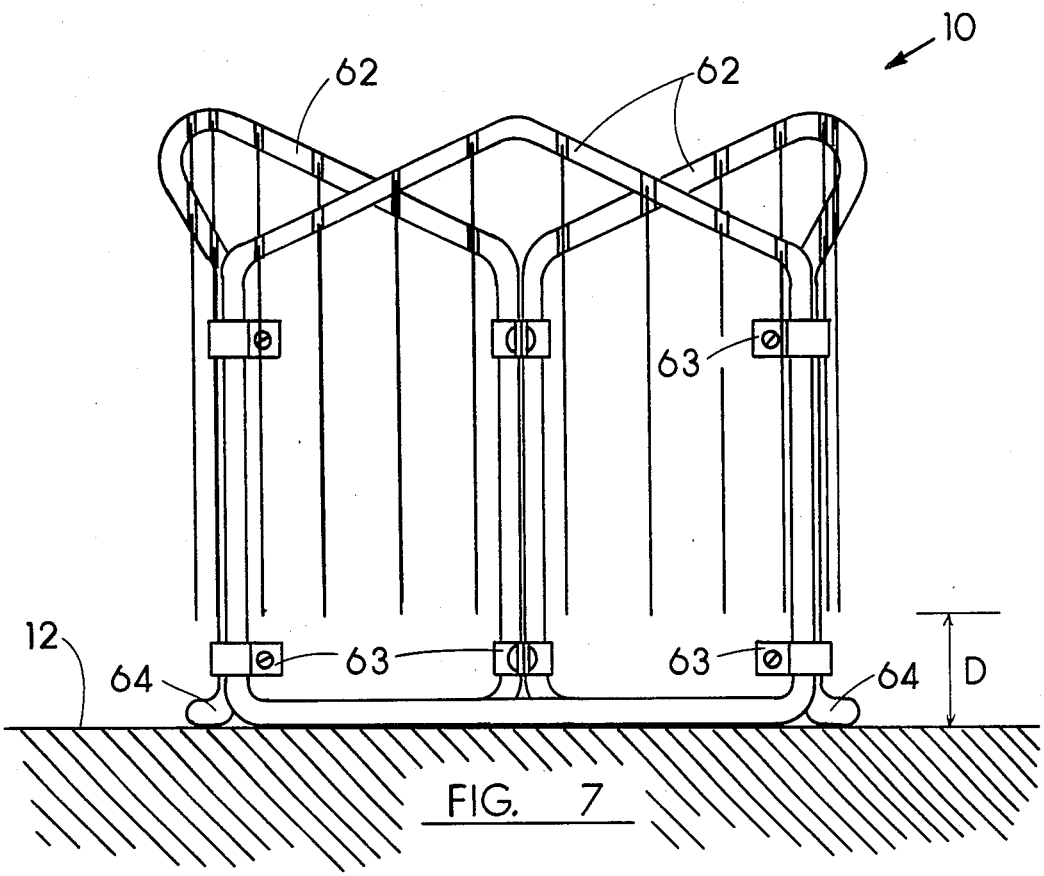
FIG. 7 is a side view of a fourth embodiment of a goal apparatus according to the present invention.

FIG. 7 and show yet another embodiment, this time employing continuous members 62 removably clamped together by clamps 63 at locations around the perimeter of the goal 10. In contrast to the embodiments of FIGS. 3, 4, 5 and 6, which have no obstructions around the perimeter of the goal 10, the embodiment of FIGS. 7 and 8 has three obstructions to the passage of an incoming object at the perimeter of the goal 10. Additionally, the continuous frame members 62 have lower legs 64 which rest upon the playing surface 12. Again, it may be necessary to use staples 56 on the lower legs 64 of this embodiment to the playing surface 12 as was indicated for the embodiment of FIGS. 3 and 4. Finally, this embodiment results in a circular-shaped goal 10, as opposed to the multi-sided configurations previously described in FIG. 3, 4, 5 and 6.

Figure 10:
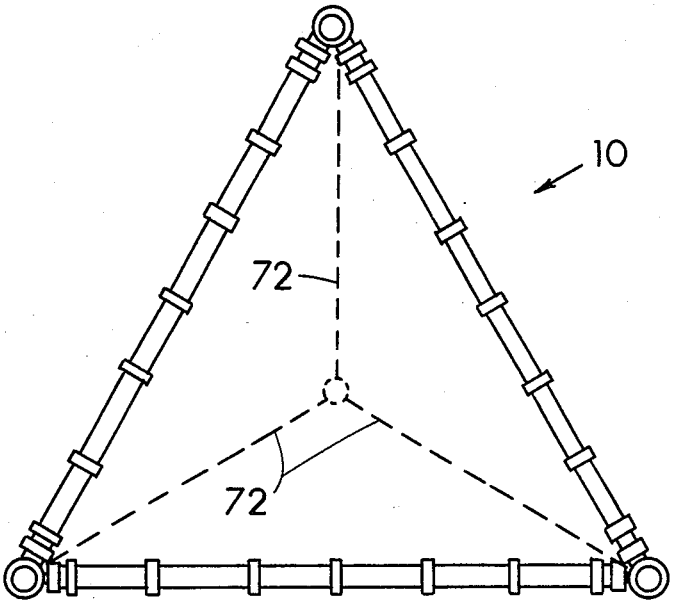
FIG. 10 is a plan view of FIG. 9.
Figure 9:
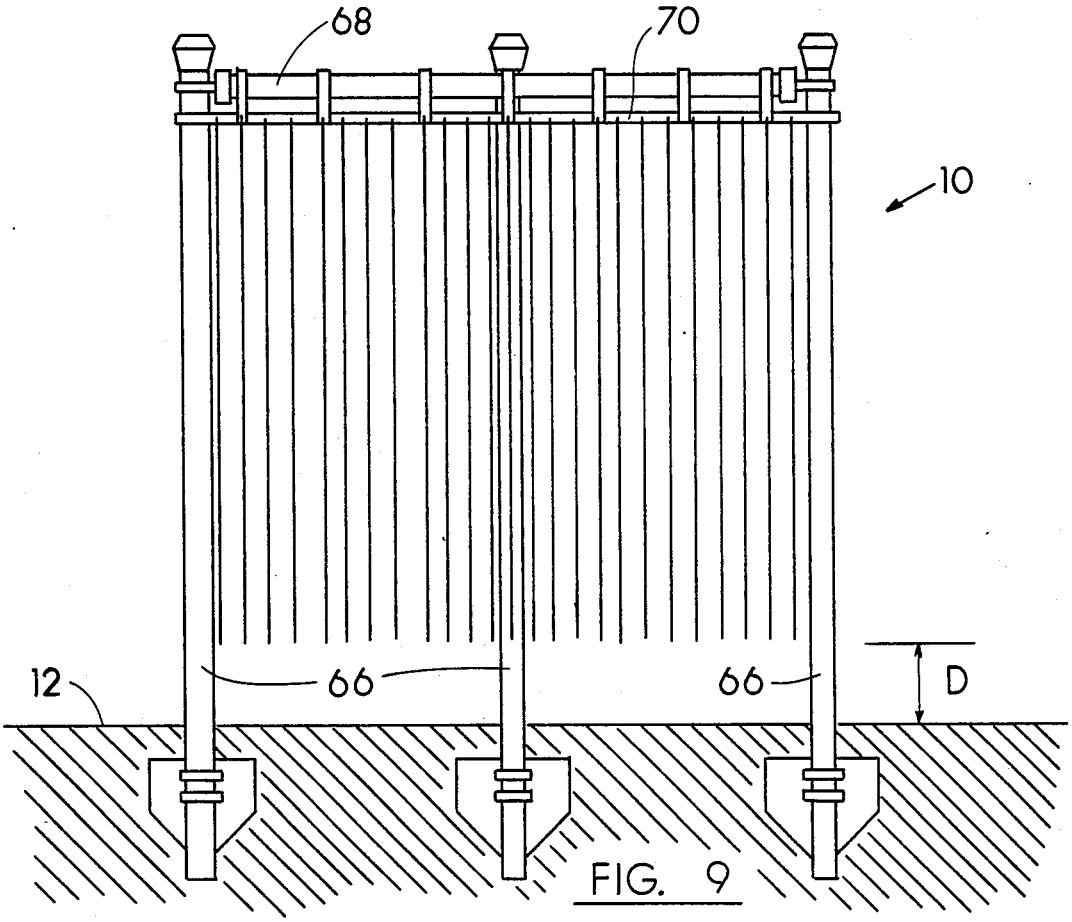
FIG. 9 is a side view of a fifth embodiment of a goal apparatus according to the present invention.

FIG. 9 and 10 describe an embodiment which can utilize standard fence parts in the construction of the goal 10, with their attendant known strength and low costs. Perimeter posts 66 are inserted into the playing surface 12. To further improve the strength of the goal 10, special upper and lower rails, 68, 70 respectively, could be welded or riveted to the perimeter posts 66 to permit the mounting of either netting 22 or suspended members 18 therefrom. Cables 72, strung between the perimeter posts 66, strengthen the goal 10 and aid in the mounting of the netting 22 or suspended members 18.

Figure 1A:
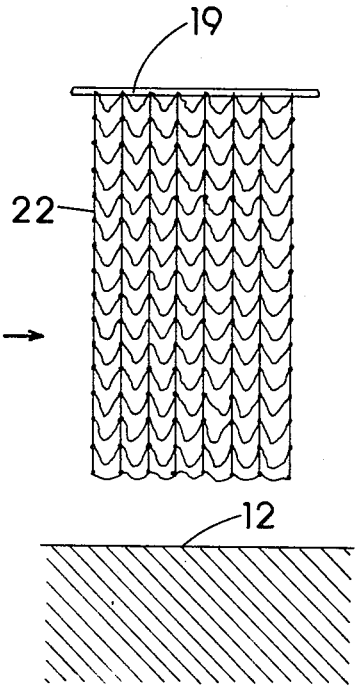
FIG. 1A is an inset figure showing a variation on the type of trapping means used in the present invention.
Figure 12:
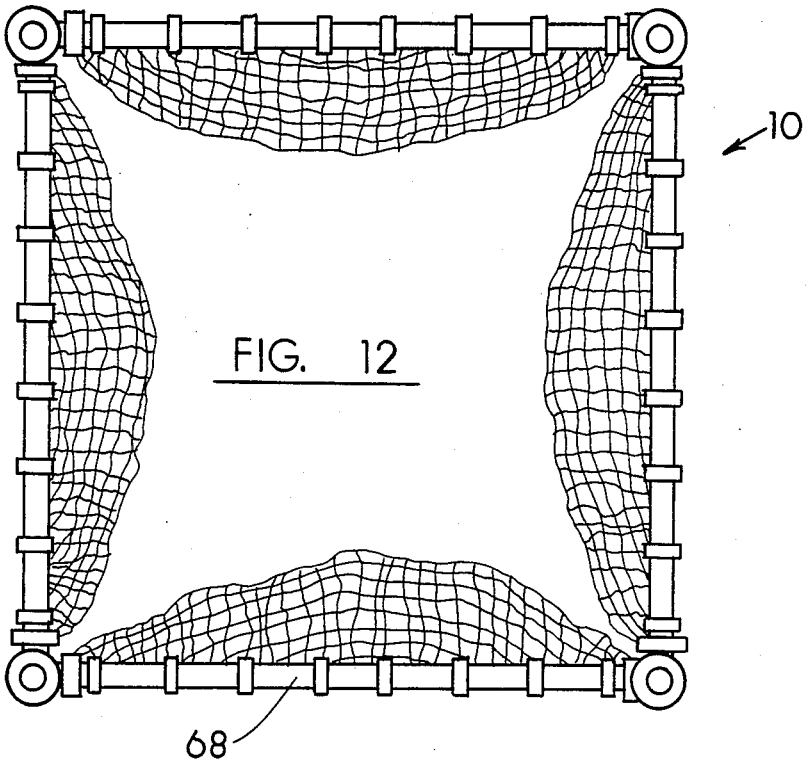
FIG. 12 is a plan view of FIG. 11
Figure 11:
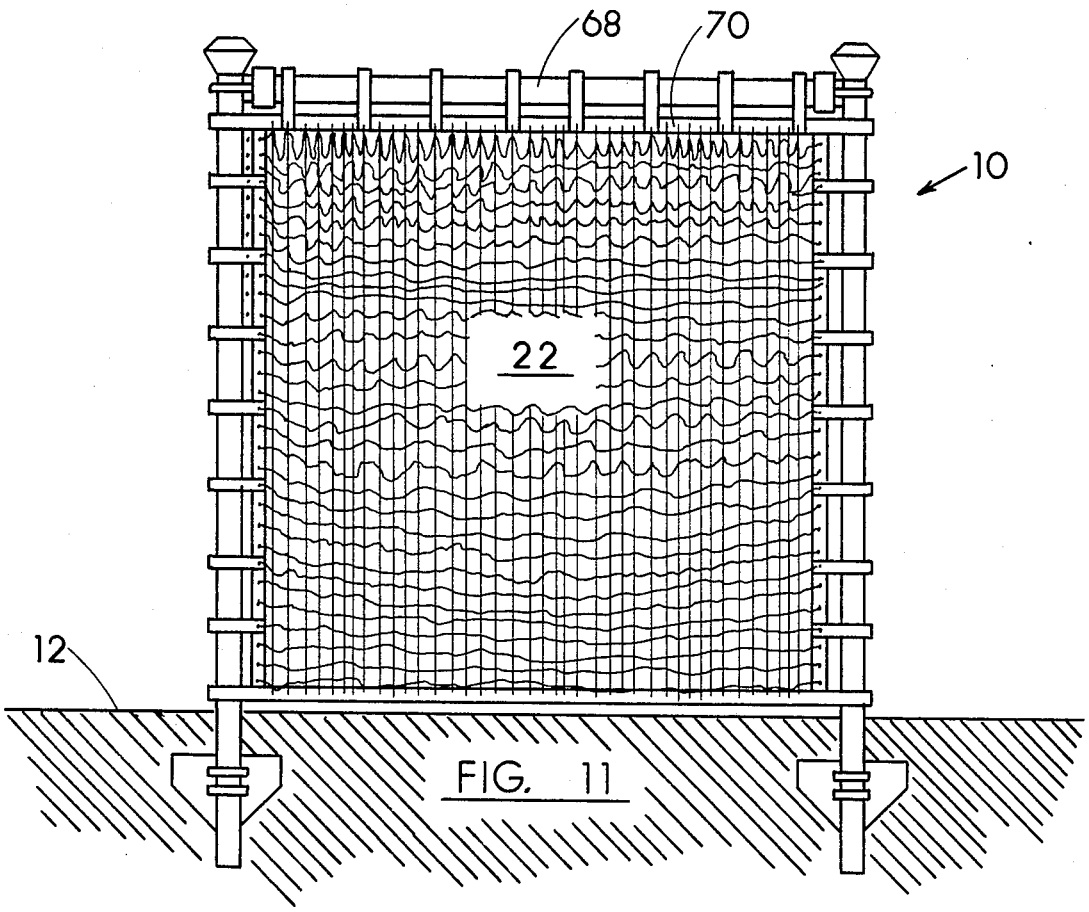
FIG. 11 is a side view of a sixth embodiment for a goal apparatus according to the present invention.

FIGS. 11 and 12 describe another embodiment, similar to that of FIGS. 9 and 10, but which utilizes one or more layers of flexible, suspended netting 22, as earlier mentioned in conjunction with FIGS. 1, 1A, and 2.

Of course, the solid mat 40 having the raised ridge 42 can be placed underneath any of the aforementioned embodiments of the goal 10. Various types of supports for the goal 10 can be implemented into other goal designs. Similarly, there is no restriction on the use of netting 22 or the individual suspended members 18 alone; combinations of the two means for selectively trapping the incoming objects could easily be employed, with one type being used for a first layer while the other being used for a second, and any subsequent layers, if desired. Thus, while specific embodiments of the present invention have been shown and described in detail to illustrate the application of the principles of the invention, certain modifications and improvements will occur to those skilled in the art upon reading the foregoing description. It is thus understood that all such modifications and improvements have been deleted herein for the sake of conciseness and readability but are properly within the scope of the following claims.

I claim:

1. A goal apparatus for a game, comprising:

a frame;

means for supporting the frame above a playing surface upon which the game is played;

means for selectively trapping objects propelled at the goal from any direction around the perimeter of the goal; and, wherein the frame is adjustable and includes a central mounting shaft attached at a lower end thereof to said means for supporting the frame on a playing surface; a top coupling, locatable along the central mounting shaft, for rotatably supporting a first end of such of a plurality of upper frame arms; and a bottom coupling, locatable along the central mounting shaft between said means for supporting the frame above a playing surface and the top coupling for rotatably supporting a first end of each of a plurality of lower frame arms, the lower frame arms being rotatably attached at a second end thereof to the upper frame arms, such that the means for selectively trapping the objects propelled at the goal can be positioned at a desired distance away from the central mounting shaft and at a desired vertical distance above the playing surface.

2. Apparatus as set forth in claim 1, wherein the means for selectively trapping the objects propelled at the goal is supported by the frame and is comprised of at least one layer of individual, suspended, independent members arranged around the perimeter of the goal which will allow an incoming object propelled at the goal to pass through the at least one layer and become trapped within the goal.

3. Apparatus as set forth in claim 2, wherein each of the suspended, independent members is rigid and is pivotally attached at only one end thereof to the frame, thereby being capable of freely swinging from the frame and deflecting out of the way when struck by the incoming object.

4. Apparatus as set forth in claim 2, wherein each of the suspended, independent members is flexible and is pivotally attached at only one end thereof to the frame, thereby being capable of freely swinging from the frame and deforming when struck by the incoming object.

5. Apparatus as set forth in claim 4, wherein each of the suspended, independent members is made of rope.

6. Apparatus as set forth in claim 4, wherein each of the suspended, independent members is made of links of chain.

7. Apparatus as set forth in claim 1, wherein the means for selectively trapping the objects propelled at the goal is supported by the frame and is comprised of at least one layer of suspended, flexible netting arranged around the perimeter of the goal which will allow an incoming object to pass through the at least one layer and trap the object within the goal.

8. Apparatus as set forth in claim 7, wherein the at least one layer of suspended, flexible netting extends downwardly towards the playing surface such that the incoming object must be trapped in the netting itself to become trapped within the goal.

9. Apparatus as set forth in claim 1, wherein the means for supporting the frame above a playing surface comprises a heavy base, attached at the lower end of the central mounting post, which rests on the playing surface.

10. Apparatus as set forth in claim 1, wherein the means for supporting the frame above a playing surface comprises an insert assembly located in the playing surface for removably receiving and holding the lower end of the central mounting post.

11. Apparatus as set forth in claim 1, further comprising a pad, extending beyond the trapping means and placed underneath the goal apparatus on the playing surface and having a raised ridge around the perimeter of the goal coextensive with the trapping means, for further defining when an object has been successfully trapped by the goal.

12. A goal apparatus for a game, comprising:

frame members, removably clamped together at a common location substantially at the center of the goal, each frame member having outwardly directed lower legs for supporting the goal above a playing surface, and outwardly directed upper arms; and means for selectively trapping objects propelled at the goal from any direction around the perimeter of the goal, said means being suspended from the outwardly directed upper arms of the frame members.

13. Apparatus as set forth in claim 12, wherein the means for selectively trapping objects propelled at the goal comprises at least one layer of individual, suspended, independent members arranged around the perimeter of the goal which will allow an incoming object to pass through at least one layer and become trapped within the goal.

14. Apparatus as set forth in claim 13, wherein the lower legs for supporting the goal are partially inserted into the playing surface to support the goal.

15. Apparatus as set forth in claim 12, further comprising a pad, placed under the goal apparatus on the playing surface and extending beyond the trapping means, and having a raised lip around the perimeter of the goal coextensive with the trapping means for further defining when an object has been successfully trapped by the goal.

16. Apparatus as set forth in claim 12, wherein the lower legs of the frame members are connected to a form a base which rests upon the playing surface to support the trapping means.

17. A goal apparatus for a game, comprising:

frame members, removably clamped together at locations around the perimeter of the goal, for supporting the goal above a playing surface;

means for selectively trapping objects propelled at the goal from substantially any direction around the perimeter of the goal, said means being suspended above the playing surface by the frame members; and a pad, placed under the goal apparatus on the playing surface and extending beyond the trapping means, and having a raised lip around the perimeter of the goal coextensive with the trapping means for further defining when an object has been successfully trapped by the goal.

18. Apparatus as set forth in claim 17, wherein each of the frame members is a continuous structure having a lower portion which rests on the playing surface and acts as a base, side portions which attach to adjacent frame members, and an upper portion from which the trapping means is suspended.

19. Apparatus as set forth in claim 18, wherein the means for selectively trapping the objects propelled at the goal is at least one layer of individual, suspended, independent members arranged around the perimeter of the goal which will allow an incoming object to pass therethrough and become trapped within the goal.

* * * * *